US005281142A

United States Patent [19]

Zaenglein, Jr.

[11] Patent Number: 5,281,142

[45] Date of Patent: Jan. 25, 1994

[54] SHOOTING SIMULATING PROCESS AND TRAINING DEVICE

[76] Inventor: William Zaenglein, Jr., 1235 Skyline Dr., Laguna Beach, Calif. 92651

[21] Appl. No.: 888,826

[22] Filed: May 27, 1992

Related U.S. Application Data

[62] Division of Ser. No. 700,269, May 15, 1991, Pat. No. 5,194,006.

[51] Int. Cl.[5] ..... F41G 3/00

[52] U.S. Cl. ..... 434/19; 434/22

[58] Field of Search ..... 273/310-316; 434/11, 12, 14-24; 73/167

[56] References Cited

U.S. PATENT DOCUMENTS

| | | | |
|---|---|---|---|
| 4,019,262 | 4/1977 | Breglia et al. | 434/20 |
| 4,290,757 | 9/1981 | Marshall et al. | 434/22 X |
| 4,685,330 | 8/1987 | Ford | 73/167 |
| 4,695,256 | 9/1987 | Eichweber | 434/22 |
| 4,988,111 | 1/1991 | Gerlizt et al. | 434/22 X |

*Primary Examiner*—Richard J. Apley
*Assistant Examiner*—Glenn E. Richman
*Attorney, Agent, or Firm*—Mark I. Feldman

[57] ABSTRACT

A user friendly shooting simulating process and training system are provided to more accurately and reliably detect the impact time and location in which a projectile shot from a shotgun, rifle, pistol or other weapon, hits a moving target. Desirably, the shooting simulating process and training system can also readily display the amount by which the projectile misses the target. The target impact time is based upon the speed and directions of the target and weapon, as well as the internal and external delay time of the projectile. In the preferred form, the training system includes a microprocessor and special projectile sensing equipment, and the targets and projectiles are simulated and viewed on display screens.

17 Claims, 4 Drawing Sheets

SHOOTING SIMULATING PROCESS AND TRAINING DEVICE

This is a division of application Ser. No. 07/700,269, filed May 15, 1991, now U.S. Pat. No. 5,194,006.

BACKGROUND OF THE INVENTION

This invention pertains to ballistic simulators and, more particularly, to a training device and process for improving the skill and accuracy of shooting weapons, such as shotguns and rifles.

It has been long been desired to provide training to improve skills in aiming and firing shotguns, rifles, handguns, and other weapons. In the past, many different types of target practice and aiming devices have been suggested that use light to simulate the firing of a gun. Such devices help train and instruct shooters by enabling them to practice aiming at a target either indoors or on an open range without actually making use of real projectiles (e.g. shot charges or bullets). The position of a projectile can be simulated by a computer and compared with the target position in order to determine whether the aim is correct.

In some systems in which shooters use a gun which emits a light beam to project a luminous mark on a screen, a successful shot with a light beam gun at a mark on a screen is indicated by the cancellation of the mark or the display of the simulated object which has been hit. Electronically controlled visual and audio indicators for indicating the hit have also been used.

In one prior art system, the flight of the target object is indicated by a constant change in the area and configuration of the target through changing the block area of the mark aperture by moveable shutter members. When the mark is hit, the movement of the shutters is ceased and a fixed configuration is projected and the flapping of the bird's wings stops. There is no way of indicating, however, that the target has been hit other than by stopping the movement of the projected image.

When using a light beam gun to shoot a concentrated light beam such as a laser beam, a target apparatus can be used to indicate the position of impact of the simulated projectile. One typical target apparatus comprises a light-receiving element such as a photo-diode or photoconductive cell. When used alone, however, such a light-receiving element can only detect whether or not a light beam discharged by a light gun has landed within a specified range on a target defined by the area of the light-receiving surface but does not indicate the exact spot within the specified range where the light beam impacts. In order to eliminate these difficulties, it has been suggested to use an electronic target apparatus with numerous light-receiving elements arranged in a plane so as to indicate which of the elements has received a light beam released by a light beam gun. A light beam gun in practical use projects a small a shot mark approximating a circle having a diameter of several millimeters. To indicate such a small shot mark on a target, it has been necessary to emit lights to correspond to the impact of simulated projectiles. Voluminous light-receiving elements have been used resulting in complex expensive electronic training equipment.

Other shooting equipment have been used. For example, one clay shooting system utilizes a light-emitting gun and a flying clay pigeon target provided with a light responsive element. Because the light responsive element is provided in the clay, the hit occurs when the light beam from the gun enters the light responsive element. Lead sighting which is required in actual clay shooting cannot be simulated by this system. Moreover, since the clay pigeon actually flies, the clay pigeon has to be retrieved for further use.

Training devices have been provided for the operation of rocket launchers, guided missile launchers, shoulder weapons or weapons of a similar type by providing the operator with conditions which are very close to those likely to be encountered under real firing conditions. Interest has also focused on training in the firing of guns from tanks, combat vehicles or other firing units of similar types.

Traditional training methods in marksmanship and firing tactics for hunters and other sportsman, police, military personnel, and others, leave much to be desired from the aspects of realism, cost and practicality. Many firing ranges have limited capacity, do not provide protection from rain or snow, are far away, or expensive. In most ranges, the targets are stationary. Furthermore, when live ammunition is used, expense, risks, administrative problems, safety concerns, and government rules and regulations are more burdensome. For initial training in marksmanship and tactics, it is preferred to have an indoor range where shooters can fire simulated projectiles against simulated moving targets.

In some systems, moving targets are projected on an indoor screen from a motion picture film and low power laser beams are aligned with the weapon barrel to simulate the firing of live ammunition. Shooters aim and fire their weapons at targets shown on the screen.

Over the years a variety of weapon simulators, training devices and other equipment have been suggested, as well as various techniques and methods for their use. Typifying these prior art weapon simulators, training devices, equipment, techniques, and methods are those described in U.S. Pat. Nos. 2,042,174; 2,442,240; 3,675,925; 3,838,856; 388,022; 3,904,204; 4,111,423; 4,137,651; 4,163,557; 4,229,009; 4,534,735; 4,657,511; and 4,799,687. These prior art weapon simulators, training devices, equipment, techniques, and methods have met with varying degrees of success, but are often unduly expensive, difficult to use, complex and inaccurate because they fail to consider the internal delay of the projectile passing through the weapon after the trigger has been pulled and the external delay during which the projectile travels to the path of a moving target.

It is therefore desirable to provide an improved shooting simulator and process which overcomes most, if not all, of the preceding problems.

SUMMARY OF THE INVENTION

A novel ballistic shooting simulator and process provides a user friendly training device and method for improving the skill and accuracy of shooting a weapon such as a shotgun, rifle or handgun. Advantageously, the novel training device and method are easy to use, simple to operate, comfortable, and helpful. Desirably, the user friendly training device and method are also effective, convenient, dependable, and accurate.

To this end, the improved ballistic simulating and training process comprises: simulating a moving target by projecting a target upon a screen; simulating firing a rifle, handgun or shotgun by projecting an image simulating in the case of a rifle or pistol, a bullet, and in the case of a shotgun, a charge of shot (all of which are generally termed "projectile" herein) upon the screen at the time the projectile exits the muzzle of the weapon;

sensing the position of the projectile; determining the position of the target; and displaying the positions of the projectile and the moving target to indicate whether the target has been hit or missed. In order to more accurately detect and display the location of the projectile relative to the moving target, the internal delay time of the projectile passing through the barrel of the weapon is determined, as is the direction and speed of the moving target and the external delay time in which the projectile travels from the weapon to the path (i.e. the plane of) the target. Such determination can be assisted and automatically calculated by a microprocessor, computer, or other central processing unit.

For more realistic training, the target can be displayed as moving towards, away, or at an angle of direction or inclination relative to the shooter, trainee, marksman, hunter, or other sportsman or person firing the weapon. The weapon can also be moved relative to the target. The weapon can be further aimed to the left or right of the moving target or aimed to shoot the projectile ahead of the moving target in either a static position or while moving the weapon so that its point of aim catches up to and passes the target.

The target can be activated by voice simulation and can be superimposed and displayed upon a landscape, pattern, or other surrounding background projected upon the screen by a film projector, large screen television (TV) projector, video cassette recorder (VCR), flat screen TV receiver, or other device. The target can be a clay target, bird (pigeon, duck, etc), animal (e.g. running boar, deer, lion, tiger, bear), disc, or can simulate an enemy, criminal, or other military or police target. The target can also be generated by a computer.

The image simulation of the projectile can be beamed and displayed upon a screen by a projector comprising a laser, infrared emitter, or other light emitting source, securely mounted about the barrel of the weapon.

The position of the moving target can be continually or intermittently determined and the position of the spot of light representing the projectile can be sensed and displayed on the screen, or on a supplemental smaller screen, monitor, or a regular or flat screen television receiver. Such sensing can be accomplished by scanning the image of the projectile relative to the moving target, with a camera, oscillator and pulse counter. Alternatively, such sensing can be accomplished by a light sensing device, such as by an infrared detector, optical fibers, or liquid display crystals. If the projectile misses the target, the missed distance is quickly signaled to the shooter or instructor by displaying the simulated positions and relative distance between the target and projectile, so that the shooter can correct his aim.

While the preceding process can be accomplished with various equipment and apparatus, a preferred user friendly ballistic simulating and training system includes a display screen for viewing a simulated moving target and a simulated projectile shot towards the target. A light projector is mounted about the barrel of the weapon (e.g. shotgun, rifle or pistol) to optically project a simulated image and aiming point of the projectile upon the screen at the time when it exits the weapon. A target projector, such as a TV projector, flat screen TV receiver, film projector, VCR or camera, optically displays the moving target on the screen. A lens and light sensing device detects the position of the simulated projectile. A central processing unit (CPU) is operatively connected to the light sensing device and to a target position circuit to automatically calculate the positions of the projectile and target when the trajectory of the projectile intersects with the path of movement of the target, based upon the position of such intersection on the target's plane and the external delay time required for the projectile to reach such position, to indicate whether the target has been hit or missed and, if missed, by what distance. An internal delay circuit can be wired to the weapon to simulate the internal delay time that the projectile passes through the weapon. A target position circuit can be connected to the CPU to determine the positions of the moving target at all times while the shot is being attempted. An external delay circuit can be connected to the light sensing device and CPU to determine the external delay time for the projectile to travel to the plane of the moving target. The light sensing device can include a camera and a scanner connected to the CPU. The scanner can comprise an oscillator, pulse counter, at least one switch, spike detector, and a scan line counter. Alternatively, the light sensing device can be comprised of an array of sensors. Various computer programs can be used in conjunction with the target position and external delay circuits to stimulate any possible combination of target speed(s) and direction(s) and projectile velocities.

The internal delay time can be characterized as the delay occurring between the time the trigger sear releases a hammer which in turn hits a firing pin, striking a primer which explodes the powder in a cartridge, with the gases from the explosion propelling a bullet, shot charge, or projectile through the barrel until it leaves the muzzle of the firearm and, therefore, is no longer under the control of the firearm and, accordingly, of the shooter. This is an actual, detectable and measurable delay which occurs in discharging firearms and the distance which a swinging gun moves during this time is accorded the term "overthrow" in some British books written on the subject of shotgun shooting. Internal delay is important because in the event, for instance, a shooter is swinging a firearm to overtake a moving target from the rear, so that the point at which the gun barrel is directed on the plane of that target moves at a greater steady speed than the target itself, or because this point is actually being accelerated past the target by the shooter, if the shooter presses the trigger and therefore slips the hammer sear at exactly the point where the gun is pointing at the target, the bullet or shot will leave the barrel of the gun at a point which is perceptibly ahead of the target on that target's plane. The converse is true in the event that the shooter starts ahead of the target and swings the gun more slowly than the motion of the target, so that the target gains on the barrel's position during the internal delay. If the trigger is pulled when the gun points directly at the target, the projectile will land behind the target on its plane, and this is true even if the projectile travelled from the muzzle to the target's plane as instantaneously as light would, i.e. even without taking into account the further disparity caused by the external delay time of the projectile's travel once it has left the firearm's muzzle. .

External delay time can be characterized as the delay between the time the projectile exits the muzzle of a firearm and the time at which it reaches that point on the plane of the target's path at which the muzzle was directed at the time of such exit. At any given speed of a projectile, the external delay will be proportional and determine how far the target travels between the time the projectile exits the firearm's muzzle and the time it reaches the plane of the target. The positions of the target at all times along its path are programmed into the CPU which, upon receiving a signal from the light projector representing the projectile leaving the firearm's muzzle, determines the target's position at such time. After applying the external delay attributable to the sensed position of the light spot representing the point at which the projectile will cross the target's plane, the positions of the projectile and target are signaled to a microprocessor, and processed in associated circuitry with various programs. Based upon this information and signals, the microprocessor can determine and indicate whether the projectile will strike the target and, if not, can indicate their relative positions, and therefore the span and distance missed between the target and projectile. Visual display of hit or amount of miss can be projected on a screen for viewing by the shooter and an instructor.

Based upon various programs simulating different target speeds and directions combined with various projectile velocities, each point on the screen where the shooter could project a shot represents a programmed in sensed external delay to the target's plane and can be indicative of the distance which a target will travel between its position at the time the projectile exits the muzzle of the firearm and the time the projectile crosses the plane of the target.

Desirably the shooting simulating processes and training devices of this invention display the relative positions of a miss when the projectile crosses the upright plane (or, if it is rising or falling directly away from the shooter, the horizontal plane) of the target and have the realism of a projected, actual target and background. Furthermore, the inventive processes and systems are extremely accurate in showing the leads required to hit a target for all different speeds, angles, and distances based upon both the internal delay time and external delay time.

Advantageously, the novel shooting simulating processes and training devices can freeze the scene when a projectile crosses and intersects the target's path to show a hit or miss, and if a miss by how much. Preferably, the shooting simulating processes and training devices can also program for angling outgoing or incoming targets, and wind speeds and directions as well as for various projectile velocities and trajectories.

A more detailed explanation of the invention is provided in the following description and claims taken in conjunction with the accompanying drawings.

DETAILED DESCRIPTION OF THE PREFERRED EMBODIMENTS

Figure 1:
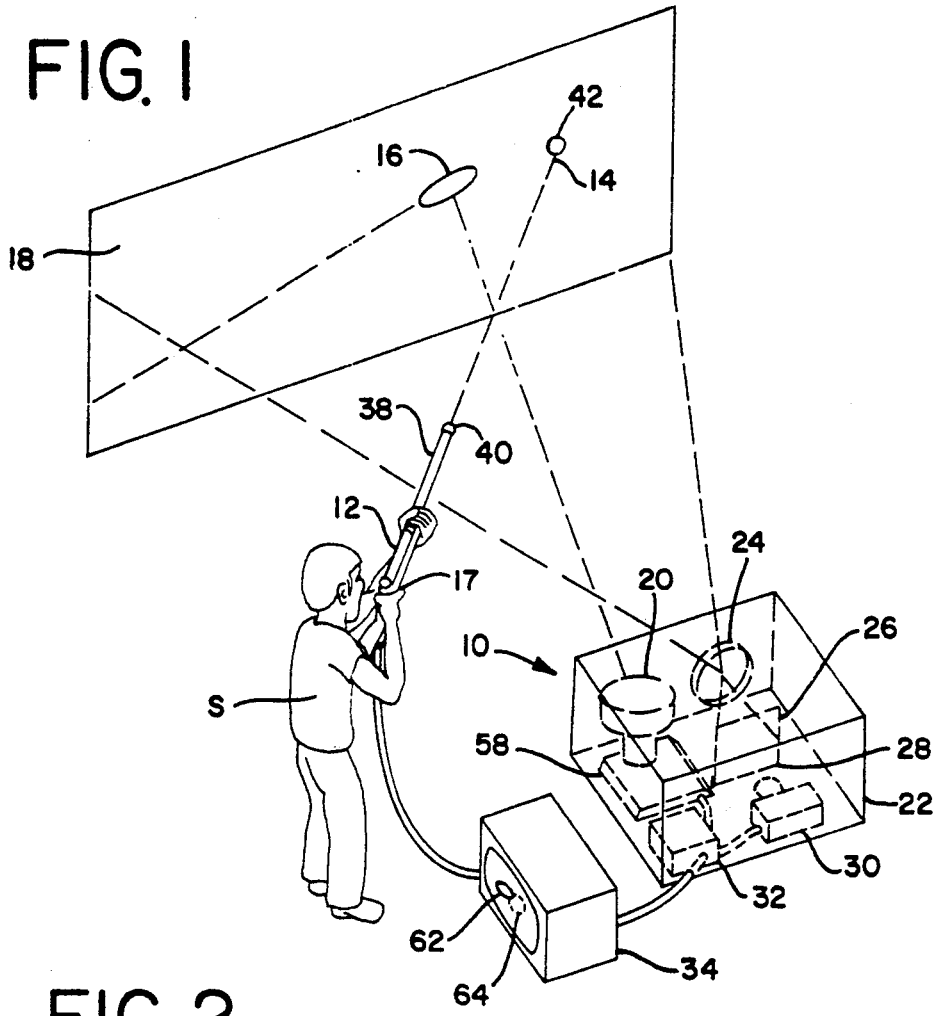
FIG. 1 is a perspective view of a shooter using a shooting simulating process and training device in accordance with principles of the present invention.
Figure 2:
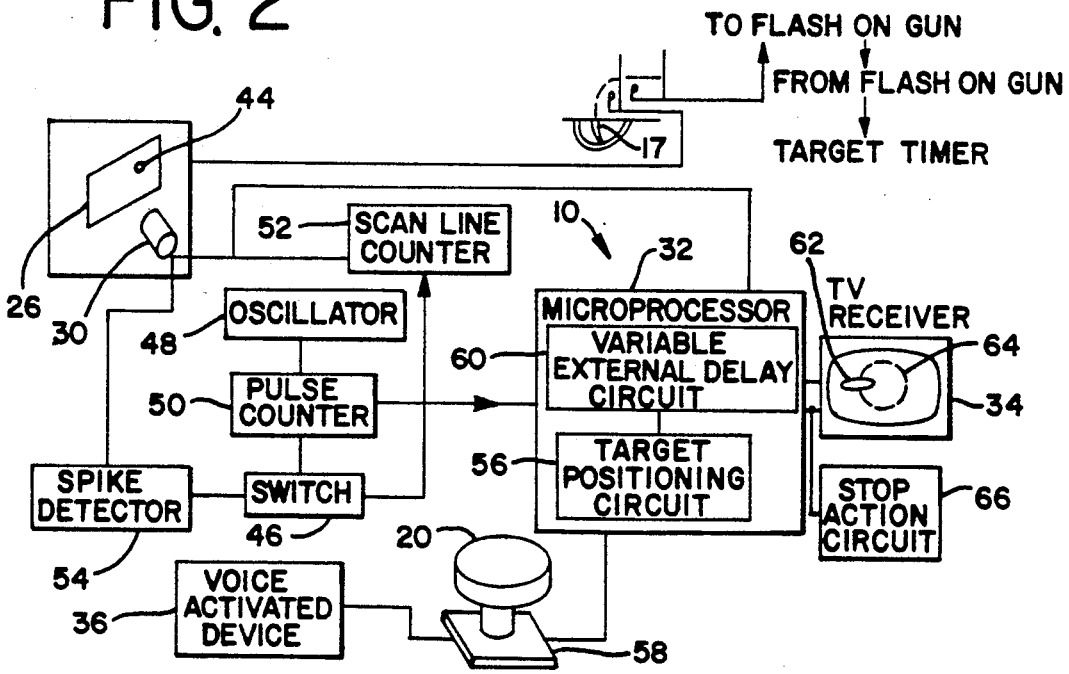
FIG. 2 is a block flow diagram of the shooting simulating process and training device of FIG. 1.

The shooting simulating process and training device 10 of FIGS. 1 and 2 indicate whether or not the amount which the shooter S holds his firearm or weapon 12, comprising a shotgun, rifle, or pistol, ahead (i.e. the lead) in order for a projectile 14 to intercept a moving target 16 is correct. The process and training device 10 can be used to simulate skeet, trap, bird or game shooting, or shooting at military or police targets at any simulated distance by actually duplicating the time lag from the time the sear of the trigger 17 slips to the arrival of the projectile at the vertical plane of the target 16 for any particular simulated distance at which the shot is taken. The shooter can select what simulated target 16 the shooter desires to practice, such as an angled shot going away or coming towards the shooter or one crossing at right angles, and what the simulated distance to the target 16 is to be at the midpoint of its path along the screen 18. This establishes the distances along the vertical plane of the target 16 represented by each point on the screen 18. The shooter also selects the velocity(s) of the projectile and the speed(s) of the target. The projectile's velocity determines th external delay time it requires to reach the simulated plane of the target represented by any point on the screen and this, along with the target's velocity, determines how far the target will travel during this external delay.

In FIG. 1, the shooter stands in front of a screen 18, wall or other light reflecting vertical surface. In practice, the shooter is, or should be, moving the firearm 12 to catch up to and stay ahead of the target 16 in order to hit the target 16. A target projector 20 is mounted in a unit 22 in front of the screen 18 to project a target image 16 of a clay target, bird, military or police target, or other target. The unit 22 also contains a lens 24 fixedly mounted to encompass the entire screen and focused on a small screen 26 contained within the unit 22 having persistence when exposed to light. Also included are: a device 28 to cancel such persistence, a small TV camera 30 which scans and encompasses the small screen 26, and a microprocessor 32. A TV receiver 34 is separately attached to the microprocessor 32.

During training or practice e.g. in the clay target game of skeet, the shooter stands before the screen 18 and calls "pull" to energize a voice actuated device 36 (FIG. 2), causing the projector 20 to project the target image 16 (FIG. 1) which then moves across the screen 18 at a uniform velocity or at any other desired rate of speed and angle in order to simulate various speeds, distances and angles representing those presented to a shooter at the various stations in skeet. The shooter then aims his weapon 12 and pulls the trigger 17 when the shooter estimates that he has provided the right amount of lead. After the internal delay time, i.e. the time between the point at which the trigger's sear slips and the exit of the charge of shot pellets from the muzzle of the barrel 38, which can be considered a fixed time, a light projector 40 on the barrel 38 of the shotgun 12 momentarily flashes a small bright spot of light 42 on the screen 18, representing the point at which the shooter was aiming when the shot 14 exited the muzzle of the barrel 38. The lens 24 projects this small spot of light 44 (FIG. 2) onto the small persistent screen 26.

Squeezing of the trigger 17 (FIGS. 1 and 2) of the weapon concurrently closes a switch 46 causing the small TV camera 30 to scan the small screen 26 for one frame. An oscillator 48 provides a pulse train which produces a predetermined number of pulses for each line of scan. As each line of the frame is scanned a pulse counter 50 counts the pulses produced by the oscillator 48. The counter 50 recycles at the end of each scan line and a scan line counter 52 keeps track of the line of the frame being scanned. When the image of the spot 44 is scanned, it will be detected by a spike detector circuit 54 which will respond to the spike of high level signal from the video amplifier to throw an electronic switch 46, stopping the pulse counter 50 to indicate the position of the spot 44 in a horizontal and vertical direction. This reading is then applied to a microprocessor circuit 32, which determines the correct "external delay" time, i.e. the time which is required for the shot charge, bullet or projectile to travel from the muzzle of the barrel 38 (FIG. 1) of the weapon to the point where it intersects the vertical plane of the target 16. This can be accomplished by interrogating a input programmed lookup table to generate the appropriate elapsed time for the distance simulated by the point on the screen 18 where the spot of light 14 is flashed. Preferably, such input is preprogrammed or inputted, such as by a keyboard, into the microprocessor 32 for each pulse of each scan line based on the particular skeet station and shot, and projectile being simulated.

At the time the target projector 20 (FIG. 1) commences to project the target image 16, a timer 58 (FIG. 2) is simultaneously activated which records the length of time the target 16 is moving until the light-emitting shot simulator and projector 40 (FIG. 1) mounted on the barrel 38 of the weapon 12 is activated (i.e. after expiration of the internal delay) and relays this information to the microprocessor 32. Based on the speed and direction of the particular target 16 being simulated, target sensing and positioning circuit 56 (FIG. 2) (also referred to as "target position circuit") then determines the position of the target 16 along its path when the shot projector 40 was activated. The additional elapsed time attributable to the external delay, which is determined or computed by a variable external delay circuit 60 (FIG. 2) is then relayed to the microprocessor 32. The microprocessor 32 then ascertains the additional distance traveled by the target 16 during this external delay time and then displays this position as a small dot 62 on the separate TV receiver 34. Simultaneously, a pattern 64, representing the pellets of shot is displayed on the separate TV receiver 34 at the same relative position on the TV receiver 34 as the spot of light 42 (FIG. 1) representing the point at which the shooter was aiming when the shot 14 exited the muzzle of the barrel 38 of the weapon 12 as was determined by the pulse counter 50 (FIG. 2) during the scan of the small screen 26. This displays the relative positions of both the target 62 and the shot 64 at the point in time that it crossed the vertical plane of the target 16 (FIG. 1) to show both whether a hit or a miss resulted and, if a miss, where and by what relative distance the miss occurred, so that the shooter can correct his or her aim on the next shot. The shot pattern 64 (FIG. 2) could be generated by the microprocessor 32 or by a separate computer and could be of less intensity than the target image or if desired, can be merely a circle. The microprocessor 32 can also actuate a suitable stop action circuit 66 to hold the superimposed images in stop motion until released. When the shooter resets the unit 22 (FIG. 1) for the next shot, a persistent cancelling device 28 is activated to extinguish the persistent spot 44 (FIG. 2) representing the last shot on the small persistent screen 26.

The internal delay time, i.e. the time between the trigger sear slipping and the exit of the shot from the muzzle of the barrel 38 (FIG. 1) of the shotgun 12 is built into the projectile simulating projector 40, via an internal delay circuit, so that a fixed delay elapses between the time the shooter pulls the trigger 17 and the time the light flashes on the screen 18. This exactly simulates the events which occur when actually shooting, since during the time the trigger sear slips and the time the shot exits the muzzle (i.e. the internal delay time) the shooter may be increasing or decreasing the actual lead on the target 16 from that which the shooter saw when the shooter pulled the trigger 17, depending on whether the shooter was swinging the weapon so that the muzzle's point of aim at the vertical plane of the target 16 was moving more or less rapidly than the target itself during this interval. The internal delay circuit provides the delay between the time when the sear of the weapon's trigger 17 slips to the time when the projectile leaves its muzzle 38, before activating the shot light projector 40 and simultaneously signaling the central processing unit 10 so that it can determine the target's position at such time.

The projector 20 can be adjustable to direct the target image in different directions, different inclines, and at different speeds. The projector 20 can comprise a motion picture projector or a large screen TV projector. A flat TV receiver can also be used. When the shooter is practicing skeet, the projector 20 preferably sequentially projects moving picture scenes taken from the various skeet stations showing the flight of the target 16 exactly as it occurs in real life. In any case, under all the various methods of projecting the target 16, the shooter may remain in one position at all times while targets 16 of different directions and angles are presented to the shooter.

Several variations may be utilized in the methods of locating the positions of the spot of light 14 representing the shot on the screen 18 and thereby determining the distance from the muzzle of the barrel 38 of the weapon 12 at which the simulated shot crosses the vertical plane of the target 16 in order to determine and compute the external delay time.

Figure 3:
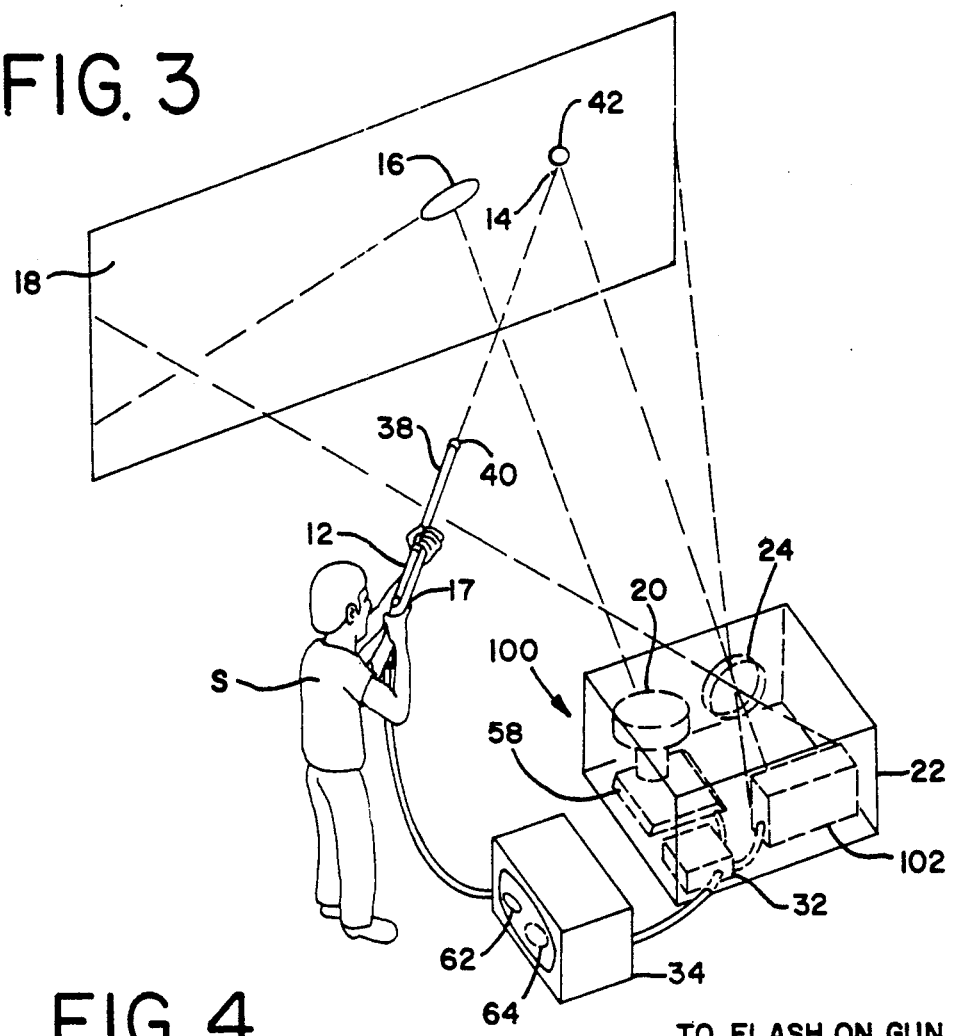
FIG. 3 is a perspective view of a shooter using another shooting simulating process and training device in accordance with principles of the present invention.
Figure 4:
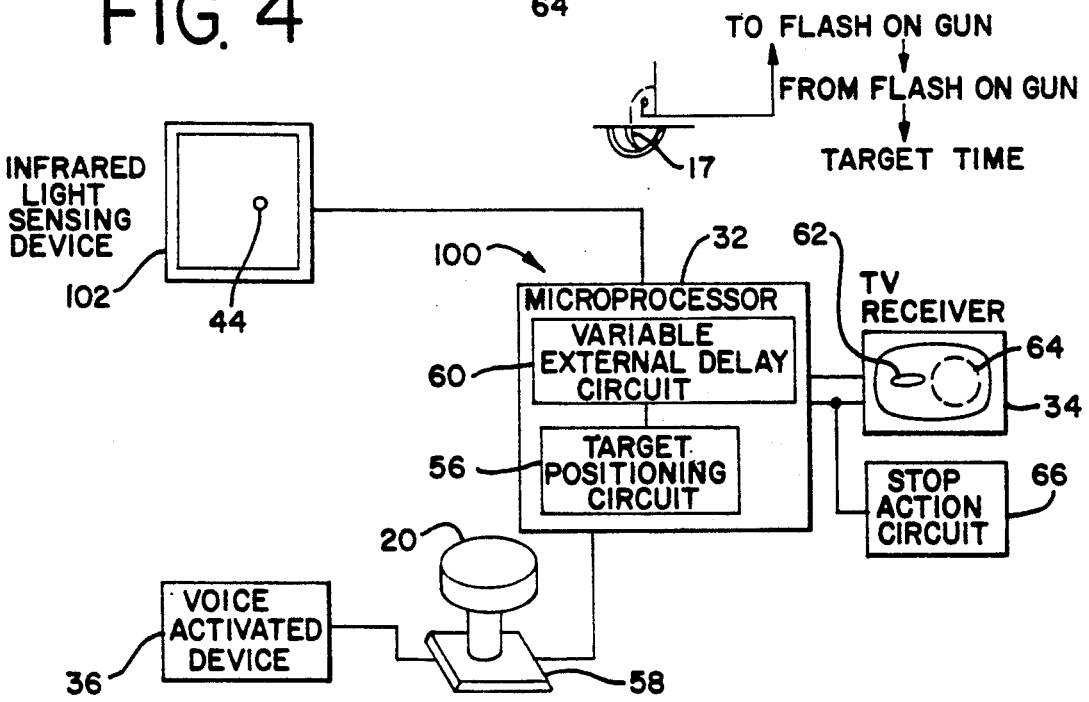
FIG. 4 is a block flow diagram of the shooting simulating process and training device of FIG. 3.

The shooting simulating process and training device 100 of FIGS. 3 and 4 are similar to the shooting simulation process and training of FIGS. 1 and 2, except that an infrared or other light sensing device 102 is substituted for the small screen and TV camera, as well as the pulse and line counters, spike detector and persistence cancelling device. The internal lens 24 is fixedly mounted to scan and encompass the screen 18 and projects its image on the infrared light sensing device 102. After the shooter fires, the simulated projectile is, after the expiration of the internal delay time, projected as a small flash of light 42 on the screen by the light-emitting projector 40 mounted on the barrel 38 of the weapon 12 and the infrared light sensing device 102 records the position of the small spot of light 42. This information is relayed to the microprocessor 32 which then functions to display the relative positions of the shot 64 (FIG. 4) and target 62, based upon the external delay time, on the separate TV receiver 34 as occurs in the embodiment described above of FIGS. 1 and 2. The sensing device 102 could also be composed of a grid of optical fibers, liquid display crystals or other display elements which become illuminated when energized and are in turn connected to sensors which relay the position of the spot of light 44 to the microprocessor 32.

Figure 5:
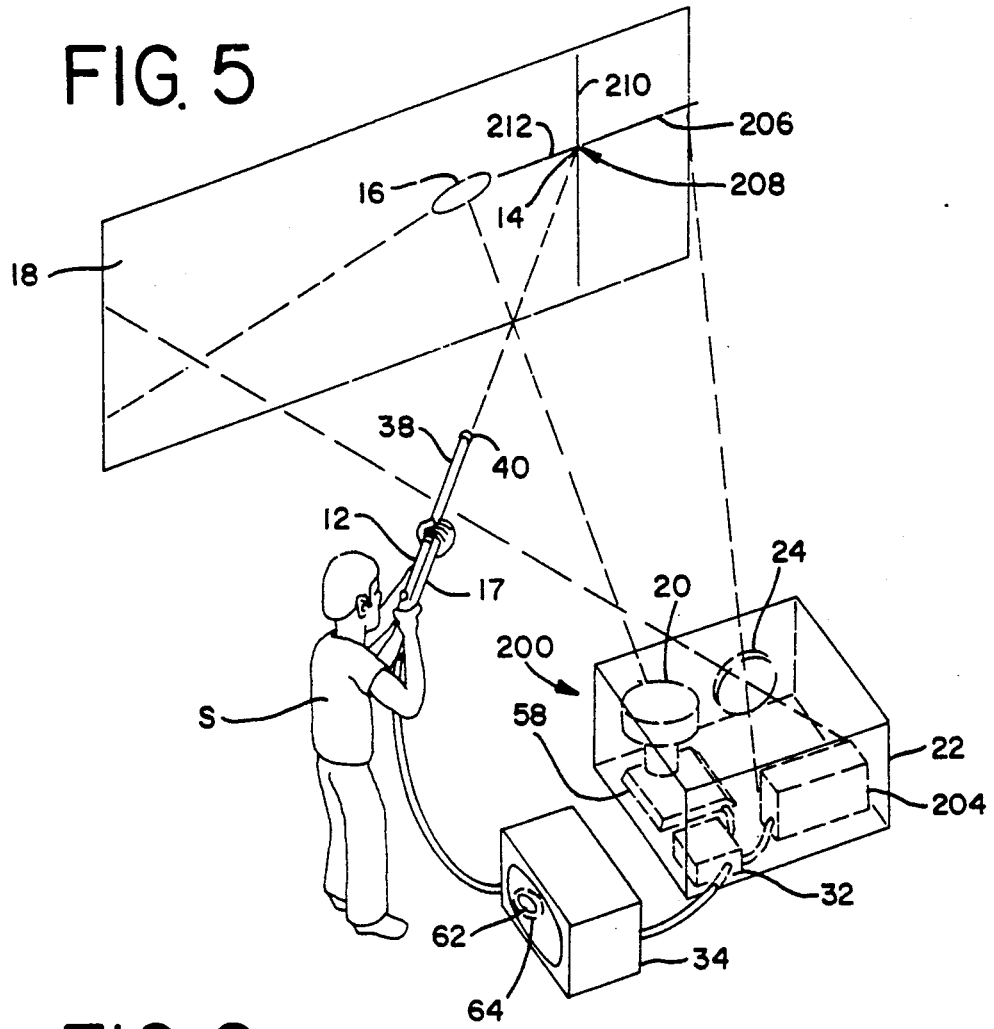
FIG. 5 is a perspective view of a shooter using a further shooting simulating process and training device in accordance with principles of the present invention.
Figure 6:
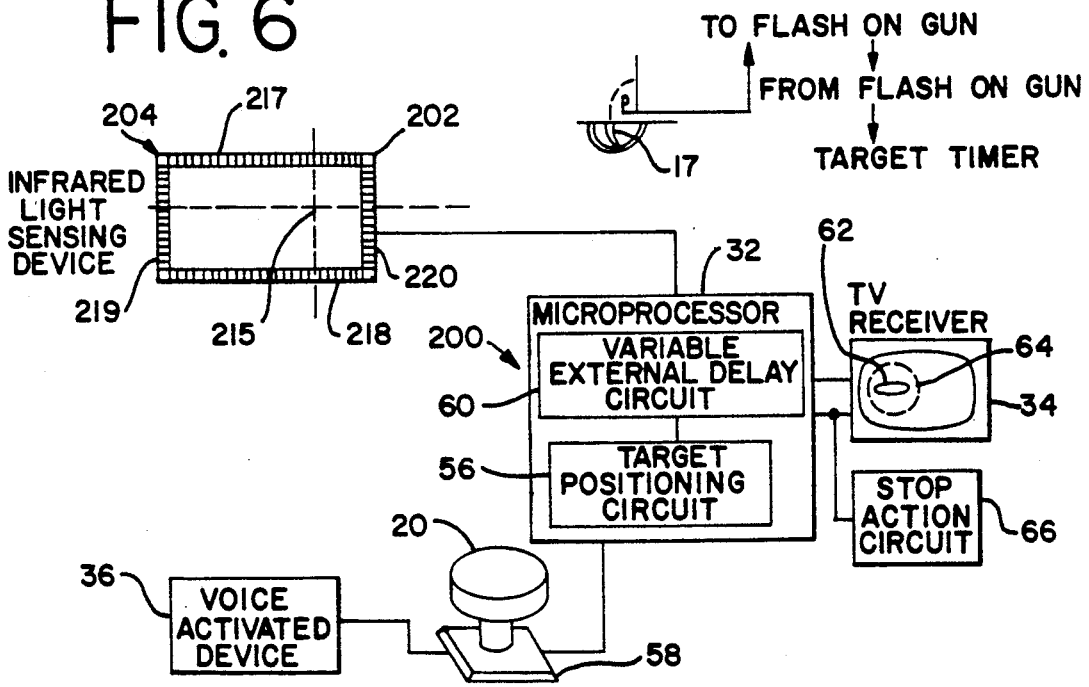
FIG. 6 is a block flow diagram of the shooting simulating process and training device of FIG. 5.

The shooting simulating process and training device 200 of FIGS. 5 and 6 are similar to the shooting process and training device 100 of FIGS. 3 and 4, except that the sensors 202 as best shown in FIG. 5, are arranged in the sensing device 204 in a rectangular pattern. Also, the projectile simulating light projector 40 on the barrel 38 of the weapon 12 flashes, emits and projects a cross-hair light pattern 206 on the screen 18. The intersection 208 of the cross-hairs 210 and 212 of the pattern 206 represents and corresponds to the the aiming point 14 when the projectile exits the muzzle of the barrel 38 of the weapon 12 after the lapse of the internal delay time. The internal lens 24 projects the cross-hair's image 215 (FIG. 6) on the rectangular array of sensors 202 activating two horizontal and two vertical sensors 217–220. This information is relayed to the microprocessor 32 which has been preprogrammed to determine the position of the shot based on which sensors 202 are activated and it then functions to display the relative positions of the shot 64 and target 62 on the TV receiver 34 as in the embodiment of FIGS. 3 and 4. Variations in the method of projecting the target and displaying its relationship to the shot at the time the latter crosses the target's vertical plane may also be used by employing a projection type TV projector or a large flat TV receiver.

Figure 7:
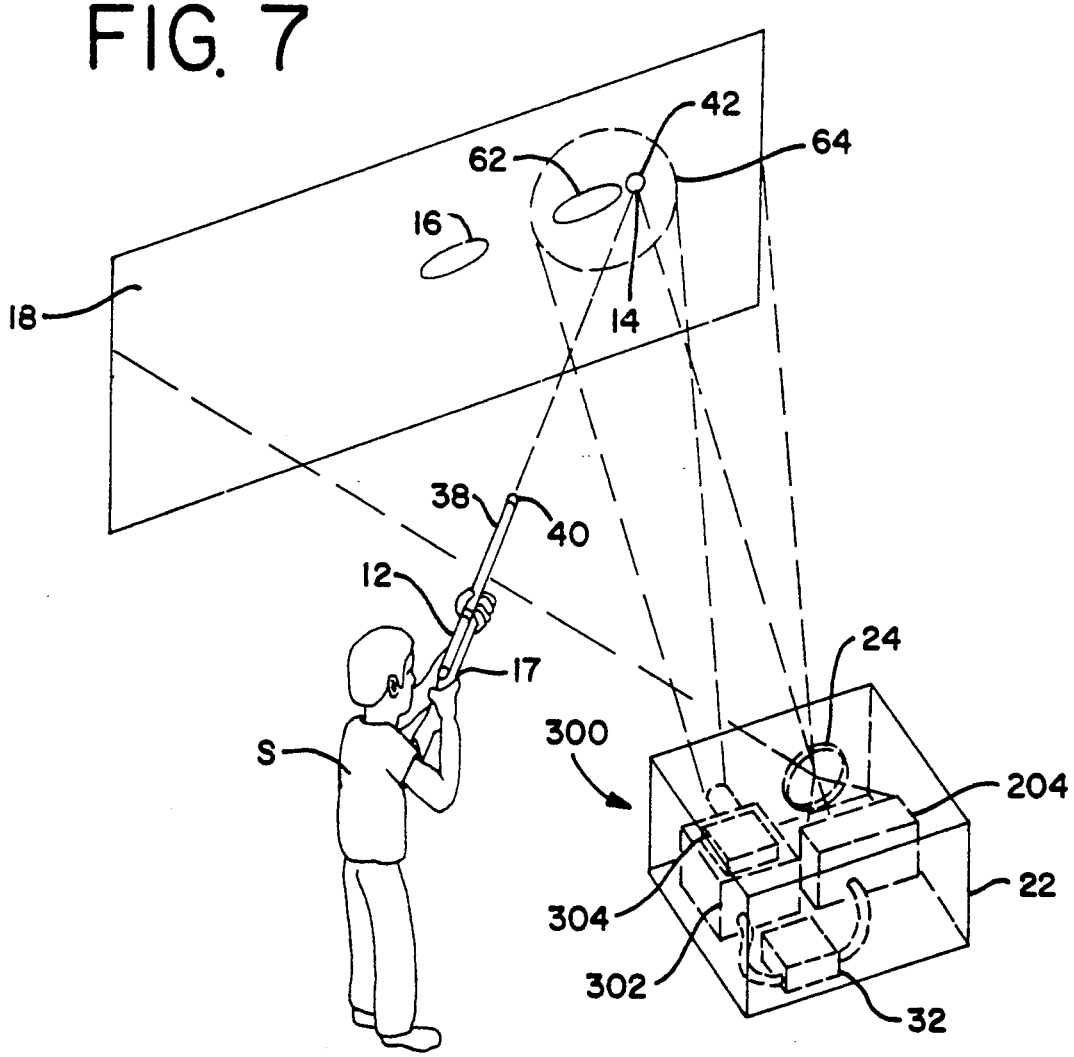
FIG. 7 is a perspective view of a shooter using still another shooting simulating process and training device in accordance with principles of the present invention.

The shooting simulating process and training device 300 of FIG. 7 are similar to the shooting process and training device 200 of FIGS. 5 and 6, except that the target projector and separate TV receiver are replaced by a projection type TV projector 302 to which is attached a video cassette recorder (VCR) 304. Tapes showing actual pictures of various targets 16 in any type of shooting game (e.g. skeet, trap, duck tower, running boar, etc.) or moving military or police targets are run on the VCR 304 and displayed on a screen 18 by the TV projector 302. Other components of the system may be the same as those utilized in the preceding embodiments of FIGS. 1–6. The TV projector 302 is, after the shot has been taken, used in lieu of the separate TV receiver to display the relative positions of the target 62 and the simulated shot pattern 64 at the time it reaches the target's vertical plane. A large flat TV receiver could also be used, if desired, for similar purposes thus eliminating the need for a separate screen 18 and TV projector 302 since the shooter will be shooting at the same unit that displays the result of his or her shot.

Furthermore, in some situations, e.g. military or police targets, where longer ranges are simulated, the lookup table which can be inputted and interrogated by the microprocessor 32 and associated circuit can include information concerning the trajectory of the projectile 14 (FIG. 7) fired by any simulated cartridge, as well as other information. This will provide information which is relayed to the projector 302 to display the amount which the bullet 14 falls and, thereby, the amount the muzzle of the barrel 38 of the weapon 12 should be held above the target 16 at any given simulated distance from the target 16, as well as the amount of lead required at such a distance.

When various programs for the target positioning circuit 56 (FIGS. 2, 4 and 6) of the microprocessor 32 are used in conjunction with the target projector 20, each point on the screen 18 of the target's path can be designated to represent a specific distance from the muzzle of the weapon to simulate the path of any target 16 at any angles, distances and speeds. Furthermore, the target 16 can be made to slow down, as would a clay pigeon after leaving a trap, or speed up, as would a bird after being flushed. Moreover, the flight of the target 16 can be simulated to fall or rise along a desired path.

Various programs for the variable delay circuit 60 (FIGS. 2, 4, and 6) can be used to indicate the time of travel ("external delay") of a projectile having any given initial and interim velocities from the muzzle of the weapon to any point on the vertical plane of the target 16 as the distance to the target's vertical plane increases or decreases. Desirably, this simulation can be accomplished for any path, angle and distance of any target 16.

The timer 58 (FIGS. 2, 4 and 6) can be used in conjunction with the target positioning circuit 56 of the microprocessor 32 to signal and indicate the time of travel and therefore the simulated distance of the target 16. The microprocessor 32 calculates and determines the simulated distance from the muzzle of the barrel 38 of the weapon 12 based upon time of travel of the projectile to strike the plane of the target 16 having any direction, angle, and speed, along a desired straight or curved rising or falling path. The timer 58 receives impulse signals from the target projector 20 at the inception of travel of the target 16 as well as from the shot projector 40 when it flashes the light which represents the simulated projectile at the time it is leaving the muzzle after expiration of the internal delay time. This information is relayed to the target positioning circuit 56 which determines the position of the target 16 at such time for any target 16 with any given direction and speed.

The variable external delay circuit 60 (FIG. 2) cooperates with the microprocessor 32 to receive signals from the pulse counter 50 and scan line counter 18 to determine and indicate the position of the aiming point 42 (FIG. 1) at which the shooter was aiming when the shot exits the muzzle of the barrel 38 of the weapon 12 after the expiration of the internal delay. The microprocessor 32 can be preprogrammed to indicate the time required for a shot charge or projectile of any given initial and interim velocities to reach all possible aiming points 42 along the target's vertical plane (i.e. the external delay time). The microprocessor 32 automatically calculates and determines the distance the target 16 will travel during this external delay until the projectile reaches the vertical plane of the target 16, and therefore the target's position at such time, for any angles, paths and speeds of the target and projectile, based upon signals and information relayed from the target positioning circuit 56.

The stop action circuit 66 (FIG. 2) and TV receiver 34 in conjunction with the microprocessor 32, circuits and other components described above, display and project the exact relative positions of any moving target and any shot charge or projectile directed at such target at the time such shot charge or projectile reaches such target's vertical plane.

The internal delay time signaled to the shot projector 40 corresponds to the time between which the trigger sear of a gun slips, i.e. the point at which a trigger 12 is pulled, and the time at which the shot charge or projectile leaves the muzzle of the weapon 12. The internal delay time takes into consideration the time of the hammer to fall, the primer to explode, the powder to ignite and its gasses expand and force the projectile through and out of the barrel 38 of the weapon 12.

The training devices 10 100, 200 and 300 take into account the distance and in what direction the muzzle of the weapon 16 moves during the internal delay time in order to show the position of the shot charge or projectile 14 when it reaches the vertical plane of the target 16, thereby replicating the sequence of events which occurs under the actual shooting conditions. The training devices and systems 10, 100, 200 and 300 also simulate how the moving target 16 traveling at any speed, direction, and distance may be hit with any type of charge or projectile possessing any initial and interim velocities and any trajectory. Furthermore, the shooting simulating processes and training devices 10, 100, 200 and 300 sense, detect, determine and display the relative positions of the target and projectile after the projectile has reached the vertical plane of the target.

Desirably, the training devices and systems 10, 100, 200 and 300 are adaptable to various means of displaying the relationship of the projectile 14 to the target 16 at the time the projectile intercepts the plane of the target, such as use of a TV receiver, projection type TV on a screen, or a large, flat wall-mounted TV receiver.

If desired, different software programs can be inputted in the microprocessor 32 to simulate an infinite number of target speeds, directions, and angles in which the target can be speeding up or slowing down, in combination with any number of different projectiles which can commence at any number of velocities and slow and drop at any number of rates. Desirably, the shooting simulating processes and training devices 10, 100, 200 and 300 of this invention are able to show results of shooting at a rapidly moving target where the distances from the muzzle of the gun to the target are changing rapidly during the time the shot is being taken. In particular, the shooting simulating processes and training devices 10, 100, 200 and 300 accurately demonstrate the result of a shot taken at a rapidly moving target which is quartering away or towards the shooter, or even one which is quickly crossing the shooter's path at a right angle. In the case of a target which is rising or falling directly away from the shooter, the target's plane can be represented by various horizontal planes rather than a vertical plane, if desired.

Desirably, the shooting simulating processes and training devices 10 and 200 use a small persistent screen 26 (FIG. 2) or a small rectangular array of sensors 202 (FIG. 6) upon which a lens 24 (FIGS. 1 and 5) focuses the image of the light spot representing the shot on the big screen 18 in the same relative position as the corresponding spot appears on the big screen 18. It is from the small persistent screen 26 (FIG. 2) or small rectangular array of sensors 202 (FIG. 6) that the shot's position is determined, either by scanning it with a TV camera 30 (FIG. 1) or in the case of sensors 202 (FIG. 6), by those sensors 202 which are activated. It is this miniaturization of the screen 26 (FIG. 2) or rectangular array of sensors 202 (FIG. 6) which help make it feasible to have an exact and accurate determination of the shot's position on the vertical plane of the target 16 without the need for a huge persistent screen or a voluminous array of sensors. Moreover, if the shot spot of light were transmitted in the form of a cross hair 208 (FIG. 5), then the rectangular array of sensor 202 (FIG. 6) would only need to have sensors 217–220 on its perimeter since the activation of four sensors at any point along its sides would determine the shot's position.

The internal delay is provided internally in the shot simulating light projector attached to the weapon. It is a fixed time between letting off the trigger and the flashing of the light spot representing the projectile.

Through the target timer and target positioning circuit the CPU always knows where the target is. There is no need to sense its position. Rather, the unit is programmed for each target which the shooter wishes to practice. Each such target's direction, inclination and speed are programmed into the unit so that for that target each point the screen represents a specific simulated distance to the target's plane and therefore a specific "external delay." Accordingly, the unit knows where the target is when the light spot fires (after internal delay), senses there the shot went, applies the appropriate external delay for that simulated distance and therefore knows where the target is at the end of this delay which is the time the shot intersects the target's plane, and so can display the relative positions of both at such time.

Because of the preceding arrangement, it is only necessary to sense one thing—the position of the light spot representing the projectile—in order to solve the entire equation of the relative positions of the target and the projectile when it crosses the latter's plane, i.e. only the position of the projectile can't be predetermined.

Among the many advantages of the novel shooting simulating processes and training devices are:

1. Outstanding performance and accuracy.
2. Superior training.
3. Excellent improvement of shooting skills.
4. Better detection of target impact time and location.
5. Enchanced tracking of moving targets and projectiles.
6. User friendly.
7. Simple to operate.
8. Economical.
9. Reliable.
10. Convenient.
11. Efficient.
12. Effective.

Although embodiments of the invention have been shown and described, it is to be understood that various modifications and substitutions, as well as rearrangements of parts, components, equipment, and process steps, can be made by those skilled in the art without departing from the novel spirit and scope of this invention.

What is claimed is:

1. A ballistic simulating and training process, comprising the steps of:

selecting a simulated target movable along a predetermined path of travel at predetermined speeds after programming the predetermined path of travel and predetermined speeds of said simulated target into a central processing unit;

projecting movement of said target upon a screen such that different locations on said screen schematically represent different distances said target moves relative to a predetermined station;

automatically calculating the location of said target at selected times as said target moves along its predetermined path of travel;

simulating firing a projectile at said target from a freely movable weapon defining said station, said simulating including projecting an image simulating said projectile upon said screen as of the time said projectile exits the muzzle of said weapon;

detecting the aim of the weapon as of the time said projectile exits said muzzle by sensing where said image simulating said projectile is projected onto said screen at the time said projectile exits said muzzle; thereafter automatically determining the position of said projectile when the trajectory of said projectile intersects the plane of the path of movement of said target; and displaying the relative positions of said projectile and said target when the trajectory of said projectile intersects with the plane of the path of movement of said target thereby indicating whether said target has been hit or missed by said projectile.

2. A ballistic simulating and training process in accordance with claim 1 wherein said target is electronically located by said central processing unit, a target timer, and a target positioning circuit.

3. A ballistic simulating and training process in accordance with claim 1 including simulating the internal delay time said projectile passes through said weapon from the time the sear of the trigger of the weapon slips to the time the projectile leaves the muzzle of the weapon; and said position of said projectile is determined in part based upon said internal delay time.

4. A ballistic simulating and training process is accordance with claim 3 including automatically calculating the external delay time said projectile travels from muzzle of said weapon to the plane of said target and wherein said position of said projectile is determined in part based upon said external delay time.

5. A ballistic simulating and training process in accordance with claim 1 wherein said image of said projectile is projected upon said screen by a projector secured about the barrel of said weapon.

6. A ballistic simulating and training process in accordance with claim 1 wherein said target is moved in relationship to the person firing said weapon, said moving including moving said target directly or at various angles towards the person firing said weapon, moving said target directly or at various angles away from the person firing said weapon, crossing said target in front of the person firing said weapon, and moving said target at an angle or angles of inclination relative to the person firing said weapon.

7. A ballistic simulating and training process in accordance with claim 1 including moving said weapon towards said target.

8. A ballistic simulating and training process in accordance with claim 1 including aiming said weapon to the left or right and above or below said moving target.

9. A ballistic simulating and training process in accordance with claim 1 wherein said simulated firing includes aiming said muzzle to shoot said projectile at a position ahead of said moving target.

10. A ballistic simulating and training process in accordance with claim 1 including displaying a simulated landscape surrounding said target upon a screen.

11. A ballistic simulating and training process in accordance with claim 1 wherein said positions are automatically calculated by a central processing unit selected from the group consisting of a computer and a microprocessor.

12. A ballistic simulating and training process in accordance with claim 1 including projecting a target comprising a simulation selected from the group consisting of a clay target, disc, bird, animal, military target, police target, enemy, and criminal.

13. A ballistic simulating and training process in accordance with claim 1 wherein said target is projected by a projector selected from the group consisting of a large screen television projector, a substantially flat screen television receiver, film projector, slide projector, motion picture projector, laser, infrared light emitter, visible light emitter, camera, and video cassette recorder.

14. A ballistic simulating and training process in accordance with claim 1 wherein the position of said projectile is sensed by a light sensing device comprising at least one member selected from the group consisting of optical fibers, liquid display crystals, infrared detector, a monitor, light sensors, laser sensors, and a television camera.

15. A ballistic simulating and training process in accordance with claim 1 wherein said displaying includes simulating the relative distance and direction said target was missed so that the aim of the weapon can be corrected.

16. A ballistic simulating and training process in accordance with claim 1 wherein said simulating said target is activated by voice simulation.

17. A ballistic simulating and training process in accordance with claim 1 wherein said sensing includes scanning said image of said projectile relative to said moving target with an oscillator, scan line counter, and pulse counter.

* * * * *